US006718651B2

(12) United States Patent
Perez et al.

(10) Patent No.: US 6,718,651 B2
(45) Date of Patent: Apr. 13, 2004

(54) PORTABLE HAIR DRYER

(76) Inventors: Louis Perez, 535 Meadowcreek Dr., Mesquite, TX (US) 75150; Walter Evanyk, 3200 Sherrye Dr., Plano, TX (US) 75074

( * ) Notice: Subject to any disclaimer, the term of this patent is extended or adjusted under 35 U.S.C. 154(b) by 165 days.

(21) Appl. No.: 10/117,776

(22) Filed: Apr. 5, 2002

(65) Prior Publication Data

US 2002/0108264 A1 Aug. 15, 2002

Related U.S. Application Data

(62) Division of application No. 09/662,860, filed on Sep. 15, 2000.

(51) Int. Cl.[7] ..... A45D 20/10

(52) U.S. Cl. ..... 34/96; 34/97; 392/374; 392/384; 392/385

(58) Field of Search ..... 34/96, 97; 392/379, 392/380, 383, 384, 385, 381, 382, 360, 363, 364, 365, 366, 367, 368, 369, 373, 374; 219/476, 480

(56) References Cited

U.S. PATENT DOCUMENTS 4,550,358 A * 10/1985 Crowley et al. ..... 361/42
6,327,428 B1 12/2001 Lo et al.
6,408,131 B2 * 6/2002 Lo et al. ..... 392/385

* cited by examiner

*Primary Examiner*—Jiping Lu
(74) *Attorney, Agent, or Firm*—Jones Day

(57) ABSTRACT

The invention relates to a portable, cordless, hair dryer/blower that has an elongated hollow body portion with a mass center line and including therein a blower motor and a heating element and having a posterior end and an anterior end. A handle portion has a longitudinal axis extending substantially transversally from and along the mass center line of the elongated body portion. The handle portion includes switch controls for operating the heating element and the blower motor. A power source has a flat base and a mass center line that, when the power source is attached to the handle portion lies substantially along the longitudinal axis of the handle and the mass center line of the elongated body portion to provide power to the manual controls and to provide a flat base structure for enabling the hair dryer/blower to stand alone.

46 Claims, 5 Drawing Sheets

PORTABLE HAIR DRYER

CROSS REFERENCES TO RELATED APPLICATIONS

The present application is a divisional of and claims priority from non-provisional U.S. patent application entitled "PORTABLE HAIR DRYER" having application Ser. No. 09/662,860 filed on Sep. 15, 2000, is currently pending and is assigned to the assignee of the present invention.

BACKGROUND OF THE INVENTION

1. Field of the Invention

The present invention relates in general to a hair dryer/blower and specifically to a portable hair dryer/blower that is so constructed as to enable it to physically stand alone on its own base and that has not only a voltage regulating circuit to control the heat produced by the element but also has a variable air inlet control, a variable air outlet control and a power control circuit that allows the heating element to obtain fill heat and then pulses it to maintain the set heat at a less power consumption of the battery 2. Description of Related Art Including Information Disclosed Under 37 CFR 1.97 And 1.98

There are many different types of hair dryers/blowers. However, none are known by applicant that are portable. For instance, typical hair dryers are shown in U.S. Pat. Nos. 4,195,217, 5,555,637 and 5,701,681. All of them, however, have AC cords attached and are not portable and self-contained.

It would be desirable to have a hair dryer/blower that is portable and held in one hand to provide the user freedom with the other hand for actions such as simultaneously using additional styling tools thus aiding in the creation of different styling techniques. Further, it would be desirable to construct the hair dryer/blower such that it will stand by itself on its base and is balanced when held thereby offering improvements in ease of operation due to minimizing the effects of the combined weight on the wrist and arm of the user. It would also be desirable in such case to conserve battery power by enabling the heating element to attain full heat and then to pulse the voltage or current applied to it in such a ratio as to simply enable the heat to be maintained depending on blower speed and air input and output.

Also, it would e desirable to provide a unit as part of the hair dryer/blower that enables a fluid to be selectively dispensed at the anterior end thereof.

SUMMARY OF THE INVENTION

Thus, the present invention relates to a portable hair dryer/blower assembly that has a number of important features. The first is that it is portable and self-contained and includes an electric heat generating coil and blower assembly.

In addition, the battery assembly, with its weight, serves as a stand for the dryer/blower and provides a means to weight balance the complete assembly when used.

The power source may contain a built-in charger or a portion of the charger such as a rectifier unit to allow AC power to coupled directly to the battery source and allow multiple batteries to be simultaneously charged.

In addition, the battery could be simply charged with DC from a power transformer coupled to a wall assembly and providing DC output in a typical fashion.

The battery is secured once it is offered internally to the dryer handle and can be inserted in only the correct way.

Also, the batteries are of a higher than normal voltage to permit a lower and longer current demand for an equivalent wattage. The desired voltage is 14 volts or above.

The dryer also has an adjustable air inlet on the posterior end of the elongated hollow body portion for regulating the amount of air entering the elongated hollow body portion. This adjustable air inlet may include a series of parallel vanes or slats that are adjustable from a minimum separation from each other to allow a minimum airflow into the elongated hollow body portion and a maximum separation from each other to allow a maximum airflow into the elongated hollow body portion.

The novel dryer/blower may also include an adjustable air outlet in the anterior end of the elongated hollow body portion for regulating the amount of air exiting the elongated hollow body portion. This adjustable air outlet may comprise an adjustable iris similar to the F-stops on a camera so that, simply by rotating a ring, the iris petals are moved closer together or further apart to form a small or large eye through which the air can pass.

Thus, the dryer/blower has the ability to supply only ambient airflow at various cubic feet per minute by regulating the anterior and posterior air inlet and air outlet as well as the ability to supply heated air at various cubic feet per minute and temperatures.

The novel dryer/blower may have a circuit that pulse modulates current or voltage to the heating element providing a duty cycle that enables the stored static heat of the heating element to be used and periodically replenished. The advantage is longer heating element life, increased battery life, increased usefulness between charges, and reduced currents when using "deep discharge battery technology" which is very costly. This pulsing circuit is activated under certain conditions when the heat button is depressed. The blower motor is operated independent of the pulsing circuit used with the heating element.

This novel pulsing circuit provides a means of regulating or preventing the dryer from over-temperature and extending the life of the heating element.

Thus, it is an object of the present invention to provide a portable, cordless hair dryer/blower that has a capability of standing alone.

It is still another object of the present invention to provide a portable hair dryer/blower that has the weight balanced by aligning the mass center lines of the elongated body portion, the handle portion and the battery base portion to provide a unit that will stand on its base and that will have proper hand and arm balance during use.

It is yet another object of the present invention to provide an adjustable air inlet on the posterior end of the elongated hollow body portion for regulating the amount of air entering the elongated hollow body portion.

It is still another object of the present invention to provide adjustable air outlet on the anterior end of the elongated hollow body portion for regulating the amount of air exiting the elongated hollow body portion.

It is also an object of the present invention to provide the novel adjustable air outlet with an iris mechanism mounted on the anterior end of the elongated hollow body portion and having petal portions moveable with respect to each other to form a controllable variable size opening from a minimum to a maximum.

It is still another object of the present invention to provide a novel heating control circuit connected between the heating element and the control switches for enabling control of the amount of heating current applied to the heating element.

It is also an object of the present invention to provide a circuit for supplying maximum heating current to the heating element to raise the temperature of the heating element quickly to a desired temperature.

It is another object of the present invention to provide a pulser circuit connected to the base of a power transistor for gating a power transistor at a predetermined on and off rate to maintain the heating element at a desired temperature once it has reached that temperature.

It is yet another object of the present invention to provide a manual control for setting the desired off/on rate at which power is applied to the heating element to maintain a desired temperature such as low, medium and high temperatures.

It is also an object of the present invention to provide a pulser circuit for automatically applying an on/off conducting pulse to a power transistor to maintain the desired temperature of the heating element.

It is still another object of the present invention to provide a step-up circuit for enabling the voltage or current to be increased only when a pulse is applied to the power transistor to supply current or voltage to the heating element.

It is yet another object of the present invention to provide an attachment to the hair dryer/blower to enable a fluid spray to be selectively dispensed at the anterior end of the elongated hollow body portion.

Thus, the invention relates to a portable, cordless hair dryer/blower comprising an elongated hollow body portion having mass center line and including a blower motor and a heating element; a posterior end and an anterior end; a handle portion having a longitudinal axis extending substantially transversely from and along the mass center line of the elongated body portion, the handle portion including switch controls for operating the heating element and the blower motor; and a power source having a flat base and a mass center line aligned with the mass center line of the elongated hollow body portion for attachment to the handle portion substantially along its longitudinal axis such that (1) power is applied to the manual controls and (2) the flat base provides a platform structure for enabling the hair dryer/blower to stand alone.

BRIEF DESCRIPTION OF THE DRAWINGS

These and other features of the present invention will be more fully understood when taken in conjunction with the following Detailed Description of the Drawings in which like numerals represent like elements and in which.

DETAILED DESCRIPTION OF THE INVENTION

Figure 1:
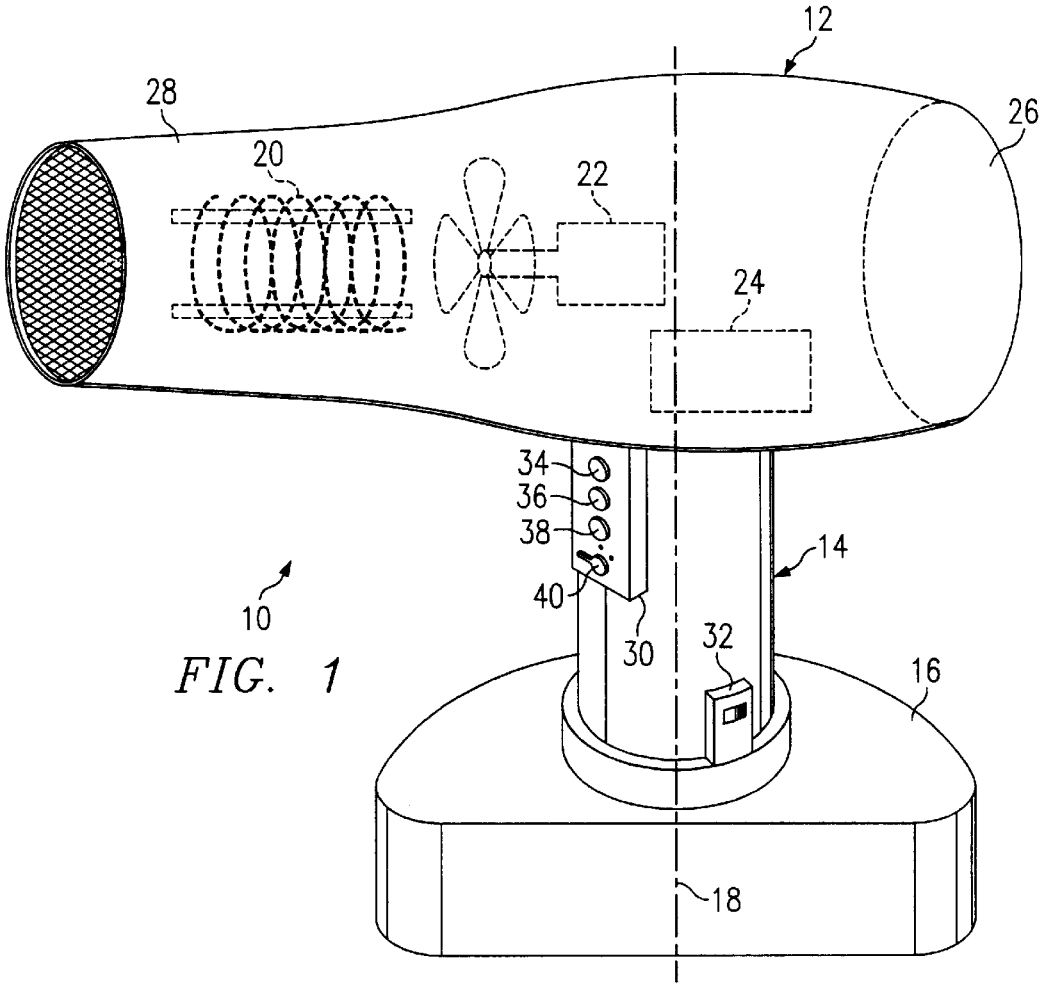
FIG. 1 is a perspective view of the novel hair dryer/blower of the present invention.

FIG. 1 is a perspective view of the novel hair dryer/blower 10 including an elongated hollow body portion 12, a handle portion 14 and a battery base portion 16.

It will be noted that the mass center line 18 of each of the elongated hollow body portion 12, handle 14, and battery base 16 are all in alignment thus allowing the unit 10 to be balanced and enables the hair dryer/blower to stand alone on the base 16. In addition, by the alignment of the mass center lines of the elongated hollow body portion 12, the handle 14 and the base 16, and proper weight distribution of the hollow body portion 12 and base 16 as can be done by those skilled in the art, balance is provided to enable the unit to be used with minimum strain on the arm and hand of the user.

The elongated hollow body portion 12 has a heating element 20, a blower motor 22 and a pulsing circuit 24 which will be described in detail hereafter. The elongated hollow body portion 12 also has a posterior end 26 and an anterior or front end 28.

Handle 14 also has a switch control pedestal 30 and a mechanism 32, well known in the art, for locking the battery/base unit 16 to the handle 14. The switch pedestal 30 includes a diode light 34, usually of green color but which may be of any desired color, a switch 36 (S1) that controls power only to the blower motor and a switch 38 (S2) that controls power to both the blower motor and the heating element. A manual control switch 40, which will be explained in detail hereafter, has multiple positions such as low, medium and high that can be selected by the user to designate the heat desired to be produced by the heating element 20.

Figure 2:
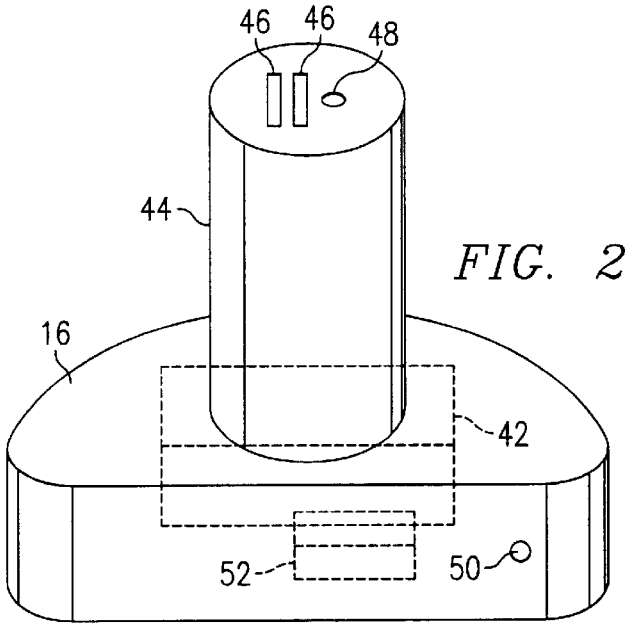
FIG. 2 is a perspective view of the novel battery that can be attached to the dryer/blower as shown in FIG. 1.

FIG. 2 discloses the base/power unit 16 which includes a battery 42 and stem 44 that can be inserted into handle 14 of the dryer/blower 10 shown in FIG. 1 and electrical terminals 46 to be received by appropriate terminals (not shown) in the handle 14 of the dryer/blower 10 illustrated in FIG. 1. The battery/base 16 may be constructed such that the stem 44 can be inserted in the handle 14 in only one direction. This may take many different forms such as a slot 48 on one side of the connectors 46. Other versions could be to shape the cross-sectional area of the stem 44 to be inserted in a corresponding receptacle shape in the handle 14 as shown in FIG. 1. The battery/base 16 may include a connector jack 50 for receiving a charging connector from the device in FIG. 3. As stated previously, that charging connector may be an AC voltage from an alternating current source if the battery/base 16 has a rectifier unit 52. This would allow a unit to be charged while it is mounted on the blower/dryer 10 as well as an additional separate unit that can be charged at the same time. The weight of the base 16 is in balance with the weight of the elongated body portion. Such balance can be easily achieved by those skilled in the art.

Figure 3:
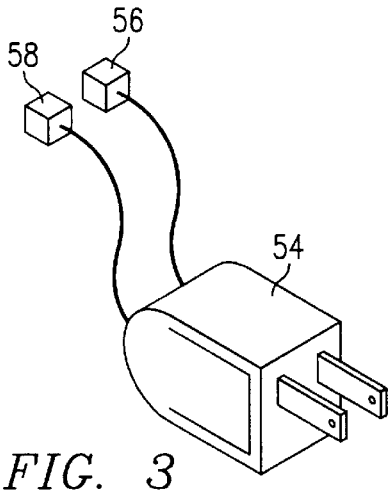
FIG. 3 is a schematic representation of a converter for supplying either AC or DC to the battery for charging thereof.

Note in FIG. 3 that an plug-in unit 54 could generate either AC or DC power output voltage on jacks 56 and 58. If the battery unit has its own rectifier unit 52, then the jacks 56 and 58 in FIG. 3 may generate AC voltage. If the battery unit is selected that does not have a rectifier 52, then the plug-in unit 54 must be an AC to DC converter and the jacks 56 and 58 would generate DC voltage.

It will be noted in FIG. 1 that the handle portion 14 has a longitudinal axis extending substantially transversally from and along the mass center line 18 of the elongated body portion 12. Again, the base unit 16 in FIG. 1 also has a mass center line that, when attached to the handle portion, lies substantially along the longitudinal axis of the mass center line 18 such that (1) power can be supplied to the manual controls 30 and (2) the flat base 16 may provide a structure for enabling the hair dryer/blower to stand alone.

Figure 4:
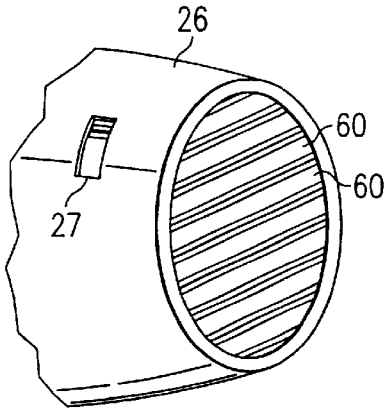
FIG. 4 illustrates adjustable vanes on the posterior end of the elongated hollow body portion of the hair dryer/blower for adjusting the air into the unit.

FIG. 4 illustrates an enlarged view of the posterior end 26 of the blower/dryer 10 shown in FIG. 1. It will be noted that it has a plurality of adjustable vanes 60 that may be moved toward and away from each other by moving a lever 27 for regulating the amount of air entering the elongated hollow body portion 12. The adjustable air inlet comprises a series of parallel vanes 60 that are adjustable from a minimum separation from each other to allow a minimum airflow into the elongated hollow body portion to a maximum separation from each other to allow a maximum airflow into the elongated hollow body portion 12.

The anterior or forward end 28 of the hollow body portion 12 also has an adjustable air inlet as will be explained hereafter in relation to FIGS. 6, 7, 8 and 9 for regulating the amount and column width of air exiting the elongated hollow body portion 12.

Figure 5A:
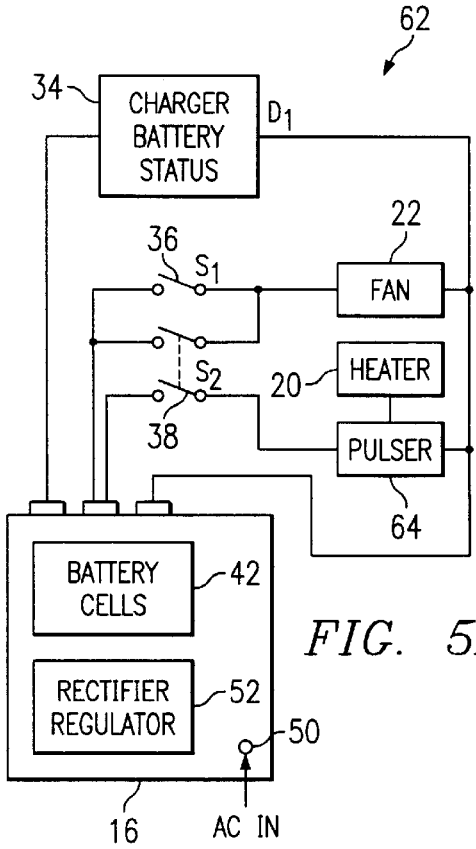
FIG. 5A is a block diagram of the control circuit for controlling the power to the blower fan and to the heating element.

FIG. 5A discloses the basic electrical circuit for controlling power to the blower fan and to the heating element. The basic circuit 62 includes the battery base portion 16 with the battery cells 42 therein and, if desired, the rectifier unit 52. It also has the jack 50 for connecting a charger thereto. When the unit is plugged into a power source, the power is immediately supplied to the LED 34 which indicates that the battery has sufficient power to operate the unit. When switch button 36 (S1) is depressed, the fan motor or blower 22 is operated alone. When switch 38 (S2) is closed, two sets of contacts are closed: one coupling power to the fan 22 and the other coupling power to the heating element 20 through a pulsing circuit 64, if desired. The pulsing circuit 64 will be described hereafter.

Figure 5B:
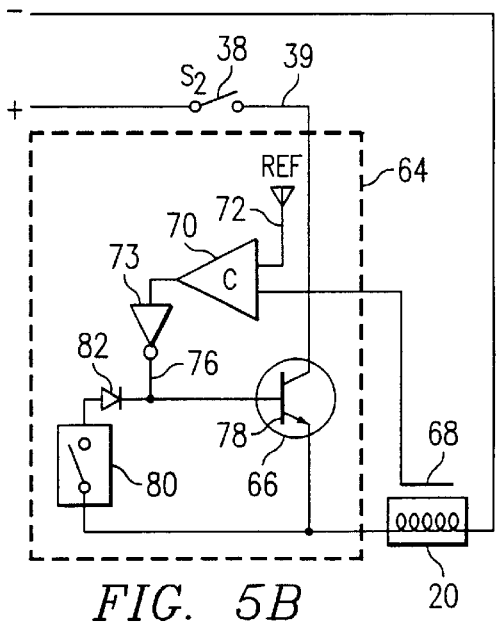
FIG. 5B is a circuit illustrating one circuit embodiment for quickly heating the heating element and then supplying pulsed current or voltage to maintain the heat.

The pulser circuit 64 is shown in detail in FIG. 5B. When the unit is first turned on and the switch 38 (S2) is depressed, both the heating element and the blower motor are energized and it is desired that the heating element heat as quickly as possible. Thus, as shown in FIG. 5B, when switch 38 is closed, conductor 39 is coupled directly to the input of transistor 66. The temperature of the heating element 20 is monitored by a temperature sensor, such as a thermocouple or thermistor. The temperature sensor 68 is coupled to a comparator 70. Another voltage reference 72 is coupled to the other input of the comparator representing the proper or maximum heating temperature of the element 20. Since there is no heat at first, there is no output from comparator 70. That lack of signal is detected by inverting diode 73 which generates an output signal on line 76 that is coupled to the base 78 of power transistor 66 causing it to conduct. Thus, full voltage is applied to heating element 20 to provide maximum heating in minimum time. As soon as the element is heated to the desired temperature, and that is sensed by sensor 68, an output signal is generated by comparator 70 that causes inverting diode 73 to remove its signal on output line 76 thus removing the continuous signal from the base 78 of the transistor 66. At this time, the pulsing circuit 80, which is isolated from the inverting diode 73 by isolating diode 82, provides pulses to the base 78 of transistor 66 to maintain the heat attained by heating element 20 without having a continuous voltage applied thereto.

Figure 5C:
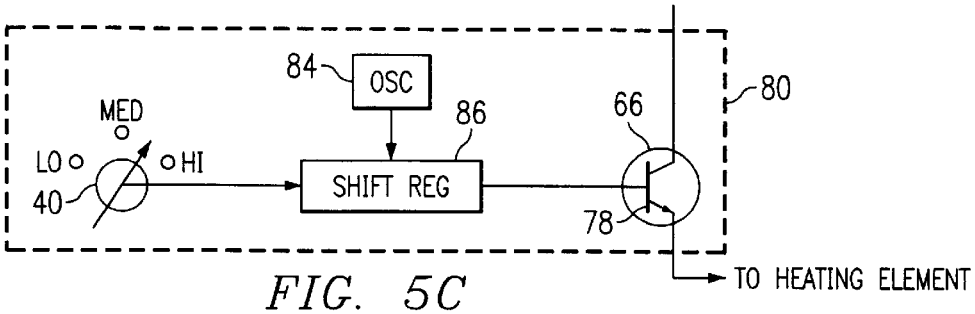
FIG. 5C illustrates the details of the pulsing circuit illustrated in FIG. 5B.
Figure 5D:
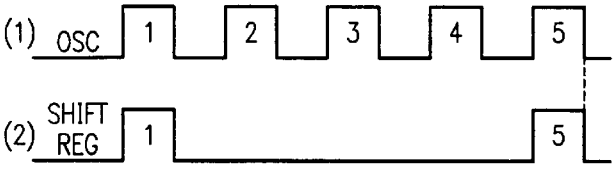
FIG. 5D illustrates in waveform 1 the oscillator output and in waveform 2 the output of a circuit illustrating a 1:4 ratio for applying pulses to the heating element.

The pulser circuit 80 is shown in detail in FIG. 5C. An oscillator 84 applies pulses to a circuit 86 that could be a shift register, a counter, or a divider circuit as shown in U.S. Pat. No. 4,571,588. It could be a 4-bit shift register for example only. The input switch 40 that is used to select low, medium and high heat, causes a selected bit from one stage of the circuit 86 to be connected to the base 78 of the transistor 66 thus causing the transistor 66 to be pulsed on and off at a given rate. An example is illustrated in FIG. 5D. The oscillator is shown to have 5 pulses in waveform 1 of FIG. 5D while the circuit 86 generates an output pulse only once for every 4 input pulses as shown in waveform 2 which means there is a 4:1 ratio of the operating time of transistor 66. For every 4 pulses received by the circuit 86, only 1 is gated to the transistor 66 allowing the transistor 66 to power the heating element 20 only ¼ of the time.

Figure 5E:
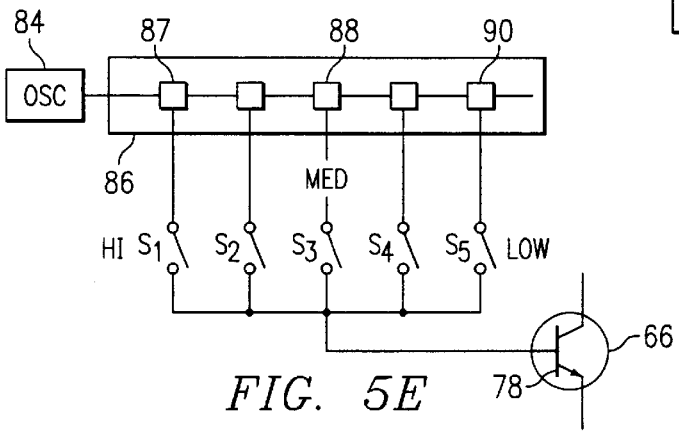
FIG. 5E is a schematic illustration of the output circuit with a manual switch control being set to high, medium and low to provide pulses and pulse ratios to the power transistor that supplies voltage and current to the heating element.

Other ratios could be selected as illustrated by the circuit in FIG. 5E where the oscillator 84 is feeding the pulses to the circuit 86. At the output of each of the 4 stages or dividers of the circuit 86, a switch (S1–S5) is connected to the base 78 of the transistor 66. If, for instance, switch S1 is selected as the high heat position, then circuit 86, at stage 87, will produce an output with every pulse received and thus high heat will be applied to the base 78 of transistor 66. If stage 88 is selected by closing switch 3 or placing the switch 40 in the medium position, then third stage 88 will be selected and a pulse will be generated through switch S3 to the base 78 of transistor 66 with every third pulse of the oscillator or a 1:3 ratio. In like manner, if stage 90 is selected with the selector position switch 40 in the low position, then every fourth pulse presented to circuit 86 will be counted and be produced through switch S5, the low position, to the base 78 of transistor 66 thus having a 1:4 heating ratio. It can be readily seen that such a circuit can not only control the amount of heat generated by the heating element 20 but also maintain the heat with less power requirements since it simply adds enough heat at periodic intervals to maintain a given heat. Thus, power is saved and the unit is more economically efficient and the battery life is prolonged.

Figure 5G:
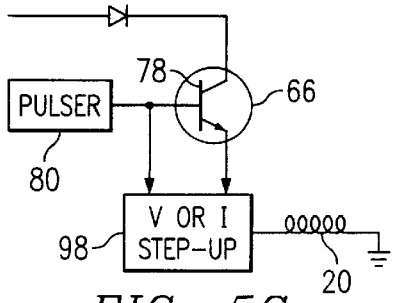
FIG. 5G illustrates a circuit for stepping-up the voltage or current only during the time the pulses are applied to the heating element.
Figure 5F:
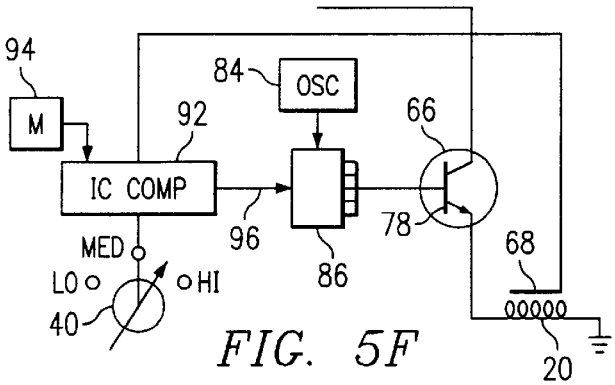
FIG. 5F illustrates an circuit for supplying pulses to the power transistor to automatically maintain a desired heater temperature utilizing an innovative control circuit.

If an automatic temperature control is desired, then the circuit of FIG. 5F should be used. As can be seen in FIG. 5F, an integrated circuit controller 92 is added as an integrated circuit chip with a memory 94 that stores a table comparing detected temperature versus counter 86 output. When the hand controller 40 is set to a position of low, medium or high, that position is detected by the integrated circuit controller 92 which then compares the temperature table with the actual temperature received from sensor 68 and through line 96 causes the proper output of counter 86 to be applied to the base of transistor 66 to supply the proper voltage or current to the heating element 20 to cause it to reach the set temperature.

It may be desirable to increase the current or voltage to the heating element during the time the pulse is applied through the transistor 66. Thus, in FIG. 5G, each time pulser circuit 80 applies a pulse to the base 78 of transistor 66, it also applies a pulse to a voltage or current step-up device 98 to increase the current or voltage to the heating element 20. Such voltage step-up device could be, for instance, a piezoelectric device, well known in the art, that, when voltage is applied to the device in one direction, causes a step-up voltage that may be detected in another direction of the piezoelectric device. Voltage and current step-up devices are well known in the art and will not be described in any further detail here.

Figure 5H:
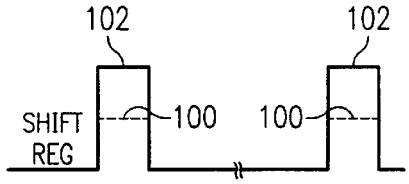
FIG. 5H illustrates the stepped-up voltage pulses that are applied to the heating element by the circuit of FIG. 5G.

FIG. 5H illustrates how the pulse is increased in magnitude. Normally the pulse is at a height 100 but a step-up to a height 102 is caused by the step-up unit 98. This increases the speed of heating of the element to the desired temperature. Further, to maintain a desired heat with such increased pulse could mean a higher pulse ratio could be used. That is, for example only, 1 pulse out of 5 instead of 1 pulse out of 3 or 4 could be used.

Figure 6:
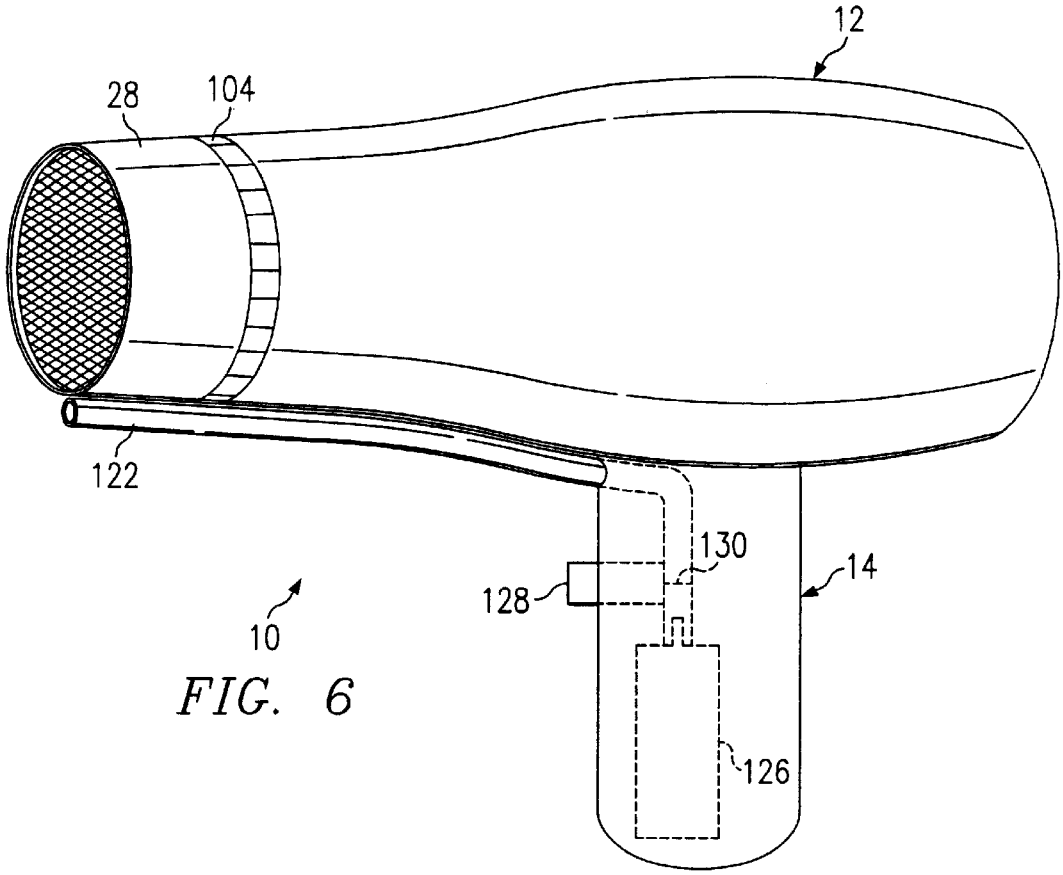
FIG. 6 is a general perspective view of a hair dryer/blower illustrating a device on the anterior portion for controlling the amount of airflow exiting the nozzle or anterior portion of the blower and including a fluid dispensing unit formed as a part thereof.
Figure 7:
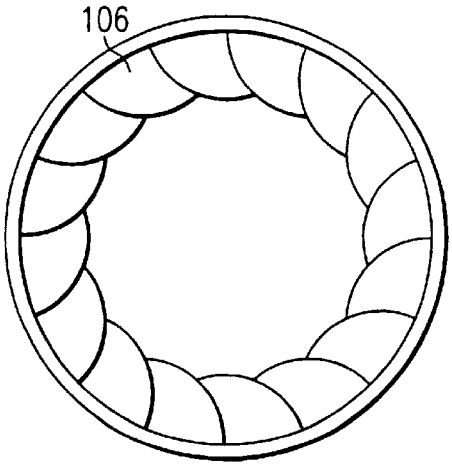
FIG. 7 illustrates an iris in the wide-open position that is controlled by the adjustment ring in FIG. 6.
Figure 8:
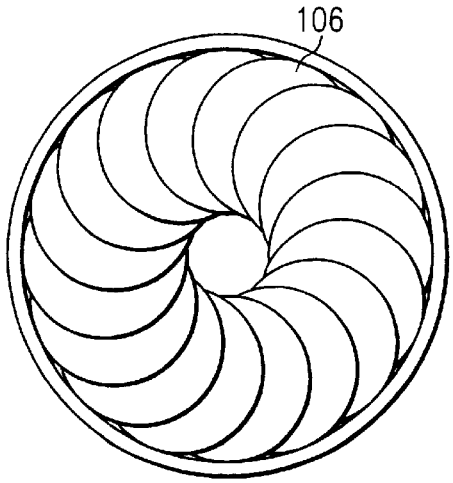
FIG. 8 illustrates the iris in the minimum closed position as adjusted by the adjustment ring in FIG. 6.

FIGS. 6, 7, 8 and 9 disclose the novel adjustable air outlet device on the anterior or forward end of the elongated hollow body portion. Thus, the exterior surface of the anterior end 28 of the elongated hollow body portion 12 has an adjustment ring 104 thereon which, by being rotated, can control the diameter of the outlet orifice of the dryer/blower 10. The movement of the adjustment ring 104 controls, in a well-known manner, a series of petals forming an iris to cause the iris petals 106 to be fully opened as shown in FIG. 7 and closed to a minimum position as shown in FIG. 8 in a well-known manner. Such an adjustment, of course, is needed by the user depending upon the task being performed with the blower/dryer at the time.

Figure 9:
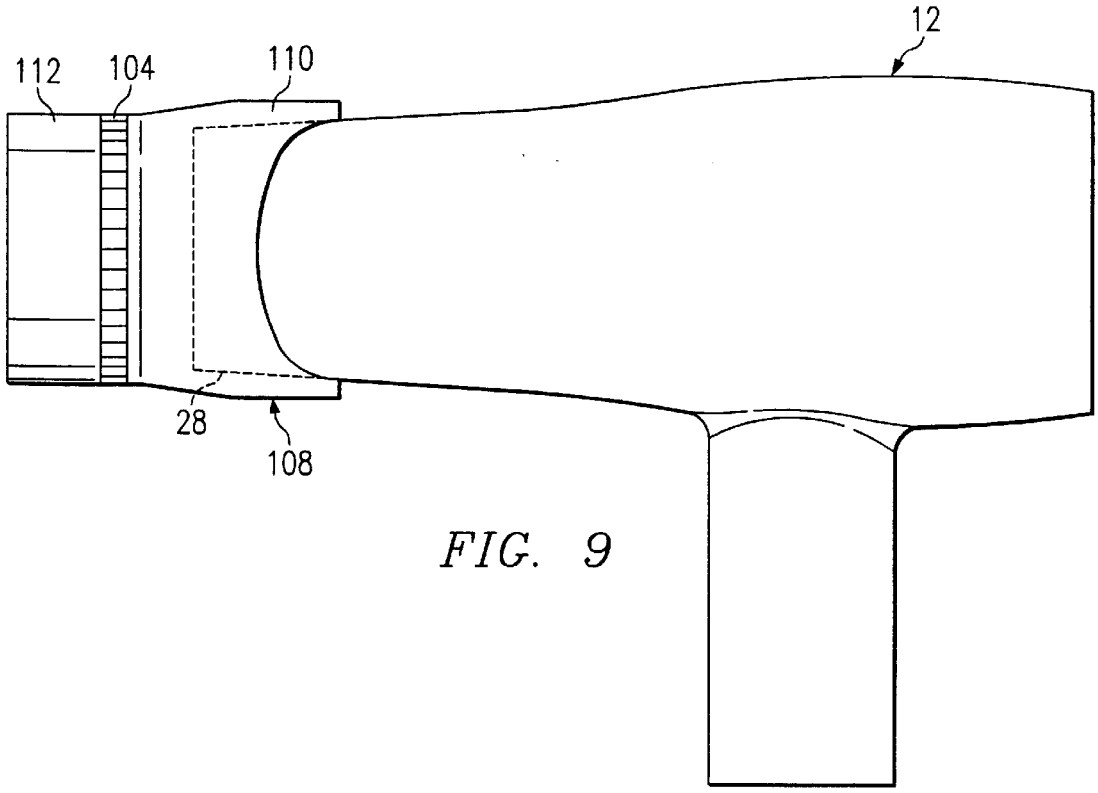
FIG. 9 illustrates an adjustment device of the type shown in FIGS. 6, 7 and 8 that can be attached in a retrofit manner to an existing dryer anterior nozzle.

Such an adjustment device can be in the form of a retrofit collar 108 as shown in FIG. 9 in the form of a hollow cylindrical portion 108 having at least a first portion 110 having an inside diameter sufficient for press-fit mating on the anterior end 28 of the elongated hollow body portion 12. It has a second portion 112 extending beyond the anterior portion or end 28 of the elongated body 12 with the adjustment iris 106 being formed on the interior of the second portion 112 of the hollow cylindrical portion 108 and the iris adjusting ring 104 being formed on the exterior of the second portion 112 of the hollow cylindrical portion 108 for manually adjusting the iris opening from a minimum diameter to a maximum diameter by moving the adjusting ring clockwise or counterclockwise. Thus, this embodiment can be used with existing dryers, the only need being to have the inside diameter of the first portion of the hollow cylindrical portion 110 of the proper size to enable the press fit with the existing dryer anterior portion 28.

Figure 10:
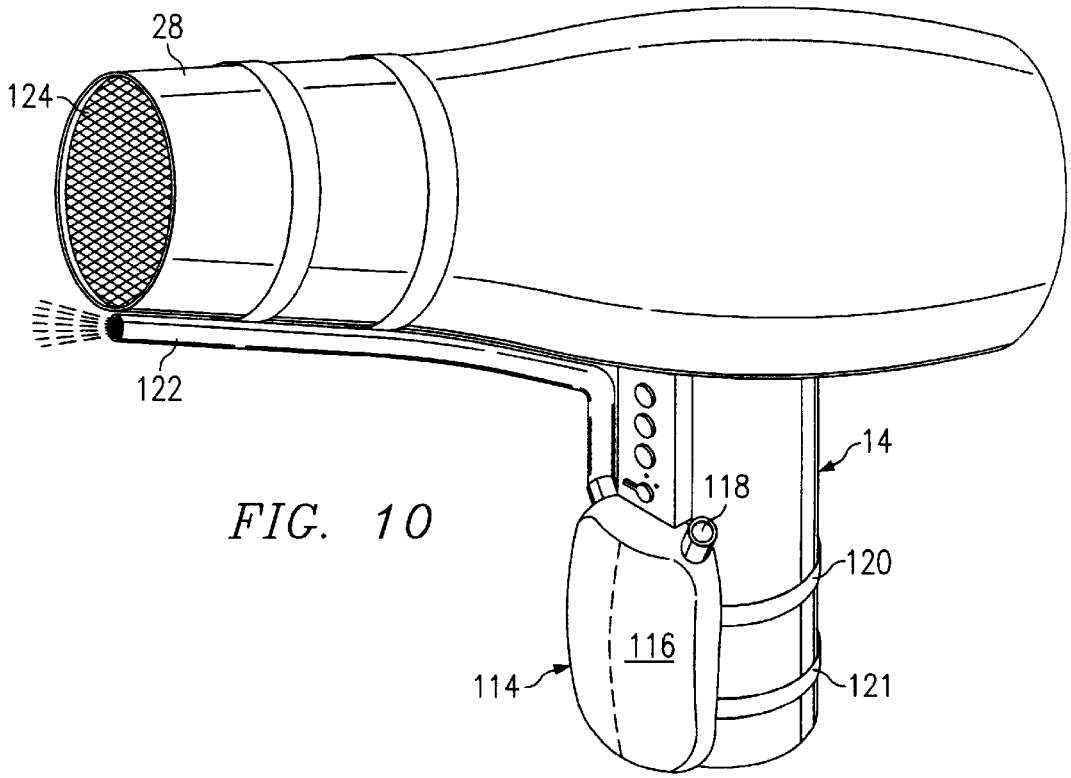
FIG. 10 is a perspective view of a novel blower/dryer that has a fluid dispenser that can be coupled to the handle portion in a retrofit manner and having a nozzle extending to the anterior end of the blower/dryer such that when the container, which is pliable or flexible, is squeezed, fluid can be ejected along the anterior portion, or forward end, of the blower/dryer.

A novel feature of the blower/dryer of the present invention is illustrated in FIG. 6 and FIG. 10. Many times the user of the blower/dryer, while styling hair needs to have moisture sprayed on the hair at different times during the process. In the embodiment shown in FIG. 6, the handle 14 is designed to enable a pressurized fluid containing cartridge 126 to be inserted therein. When trigger button 128 is selectively depressed, a valve 130 is opened in any well-known manner allowing fluid under pressure to be forced through tube 122 to the outer end 28 of the blower/dryer. Valve 130 is shown as a flapper valve for purposes of simplicity. Obviously, any well known type of valve can be used.

In the embodiment shown in FIG. 10, a retrofit fluid spray device 114 is removably attached to the blow dryer handle 14 for enabling a fluid spray to be selectively dispensed at the anterior end 28 of the blower/dryer. As can be seen in FIG. 10, the fluid spray device 114 comprises a pliable fluid container 116 having a closeable opening 118 for inserting a fluid therein and straps 120 and 121 for attaching the container 114 to the handle portion 14. Such straps could be hook-and-loop straps for example. Extending from the pliable fluid container 116 is an elongated tube 122 that extends to the outer end 124 of the blower/dryer where the spray can be sprayed by the user simply squeezing the pliable container 116. The elongated tube 122 preferably extends along the profile of the elongated hollow body 12 as for instance on the underside as shown to the anterior end thereof such that when the pliable container is squeezed, fluid is ejected at the anterior end of the elongated hollow body as needed. While the embodiment shown in FIG. 6 describes a pressurized container, it will be obvious to those skilled in the art that a well-known trigger operated device could be used wherein when the trigger is depressed and released, fluid is drawn from the container and is released under pressure. Such devices are found in children's water pistols.

Thus, there has been disclosed a novel hair dryer/blower that is portable, self-contained, having a controllable heating element temperature including manual or automatic control by the use of a novel pulsing circuit that has a variable airflow inlet control at the posterior end of the blower/dryer and a controllable air outlet opening at the anterior or forward end. The device also has an attachable liquid spray unit which can be strapped to the handle and when squeezed, fluid ejected through a tube that extends through the outer end of the dryer/blower.

While preferred embodiments have been shown and described, various modifications and substitutions may be made thereto without departing from the spirit and scope of the invention. Accordingly, it is to be understood that the present invention has been described by way of illustration and not limitation.

The corresponding structures, materials, acts, and equivalents of all means or step plus function elements in the claims below are intended to include any structure, material, or act for performing the function in combination with other claimed elements as specifically claimed.

What is claimed is:

1. A portable hair dryer/blower comprising:

a hollow body portion having a first interior cavity and including a blower motor and a heating element disposed substantially within the first interior cavity of the hollow body portion;

a handle portion having a second interior cavity, said handle portion extending from said hollow body portion;

a power source at least partially disposed within at least one of said first interior cavity of the hollow body portion and said second interior cavity of the handle portion, said power source electrically coupled to said blower motor and to said heating element, wherein said power source provides power to said blower motor and said heating element;

switch controls electrically coupled between said power source and said blower motor and between said power source and said heating element, wherein said switch controls selectively interrupts power to at least one of said blower motor and said heating element; and a pulsing circuit at least partially disposed within at least one of said first interior cavity of the hollow body portion and said second interior cavity of the handle portion, said pulsing circuit electrically coupled between said power source and said heating element for modulating power to said heating element, thereby establishing a duty cycle enabling stored static heat of said heating element to be ex ended and replenished periodically with the duty cycle.

2. The hair dryer/blower of claim 1, wherein said pulsing circuit further comprises a circuit for supplying unmodulated power to said heating element.

3. The hair dryer/blower of claim 2, wherein said circuit for supplying un-modulated power comprises:

a sensor for sensing a heating element temperature and generating a corresponding signal;

a comparator for comparing a reference signal to said sensed signal and providing a first output; and a power transistor electrically coupled between said power source and said heating element, said power transistor further having a trigger electrically coupled to said comparator, wherein said power transistor provides unmodulated power to said heating element based on the first output.

4. The hair dryer/blower of claim 3, wherein said pulsing circuit further comprises:

a pulser circuit electrically connected to said trigger of said power transistor for providing output pulses to said trigger of said power transistor at an on/off rate for providing modulated power to said heating element based on the output pulses.

5. The hair dryer/blower of claim 4, further comprises a manual control coupled to said pulser circuit for setting a desired on/off rate for providing modulated power to said heating element.

6. The hair dryer/blower of claim 5, further comprising:

a voltage step-up circuit coupled between said power transistor and said heating element and coupled to said pulser circuit for receiving said on/off rate, said voltage step-up circuit providing a voltage step-up to said heating element synchronously with said trigger of said power transistor receiving pulses at said on/off rate.

7. The hair dryer/blower of claim 4, wherein said pulser circuit further comprises:

an oscillator circuit for generating sequential pulses;

a circuit for receiving said sequential pulses, said circuit comprising a plurality of serial stages, each of the plurality of serial stages generating an output pulse in response to receiving a particular pulse in said sequential pulses;

a plurality of multiple position switches, each of the plurality of multiple position switches electrically coupled between one of said plurality of serial stages and said trigger of said power transistor; and means for positioning at least some of said plurality of multiple position switches for passing at least one of said output pulses from one of the plurality of serial stages to said trigger of said power transistor at said on/off rate.

8. The hair dryer/blower of claim 7, further comprises:

means for manually selecting an element temperature; and an integrated circuit controller having a memory and a table stored in said memory indicating heating element temperature versus pulse rate, said integrated circuit controller coupled to said means for manually selecting and coupled between said heating element heat sensor and said trigger of said power transistor, for receiving the selected element temperature from said means for manually selecting and receiving the corresponding signal from said heating element heat sensor and in response to the selected element temperature, the corresponding signal and indications from said table stored in the memory of the integrated circuit controller, generating a control signal for controlling said on/off rate to said trigger of said power transistor.

9. The hair dryer/blower of claim 8, wherein said control signal for controlling said pulse rate forming said means for positioning at least some of said plurality of multiple position switches for designating a pulse rate.

10. The hair dryer/blower of claim 4, further comprises:

means for manually selecting an element temperature; and an integrated circuit controller having a memory and a table stored in said memory indicating heating element temperature versus pulse rate, said integrated circuit controller coupled to said means for manually selecting and further coupled between said heating element heat sensor and said trigger of said power transistor for receiving the selected element temperature from said means for manually selecting and receiving the corresponding signal from said heating element heat sensor and in response to the selected element temperature, the corresponding signal and indications from said table stored in the memory of the integrated circuit controller, generating a control signal for controlling said on/off rate to said trigger of said power transistor.

11. The hair dryer/blower of claim 1, wherein said pulsing circuit further comprises:

a power transistor having an input electrically coupled to said power source, an output electrically coupled to said heating element and a trigger; and a pulser circuit electrically connected to said trigger of said power transistor for providing output pulses to said trigger of said power transistor at an on/off rate for providing modulated power to said heating element based on the output pulses.

12. The hair dryer/blower of claim 11, further comprises a manual control coupled to said pulser circuit for setting a desired on/off rate for providing modulated power to said heating element.

13. The hair dryer/blower of claim 11, wherein said pulser circuit further comprises:

an oscillator circuit for generating sequential pulses;

a circuit for receiving said sequential pulses, said circuit comprising a plurality of serial stages, each of the plurality of serial stages generating an output pulse in response to receiving a particular pulse in said sequential pulses;

a plurality of multiple position switches, each of the plurality of multiple position switches electrically coupled between one of said plurality of serial stages and said trigger of said power transistor; and means for positioning at least some of said plurality of multiple position switches for passing at least one of said output pulses, from one of the plurality of serial stages to said trigger of said power transistor at said on/off rate.

14. The hair dryer/blower of claim 13, further comprises:

a sensor for sensing a heating element temperature and generating a corresponding signal;

means for manually selecting an element temperature; and an integrated circuit controller having a memory and a table stored in said memory indicating heating element temperature versus pulse rate, said integrated circuit controller coupled to said means for manually selecting and coupled between said heating element heat sensor and said trigger of said power transistor, for receiving the selected element temperature from said means for manually selecting and receiving the corresponding signal from said heating element heat sensor and in response to the selected element temperature, the corresponding signal and indications from said table stored in the memory of the integrated circuit controller, generating a control signal for controlling said on/off rate to said trigger of said power transistor.

15. The hair dryer/blower of claim 14, wherein said control signal for controlling said pulse rate forming said means for positioning at least some of said plurality of multiple position switches for designating a pulse rate.

16. The hair dryer/blower of claim 11, further comprises:

a sensor for sensing a heating element temperature and generating a corresponding signal;

means for manually selecting an element temperature; and an integrated circuit controller having a memory and a table stored in said memory indicating heating element temperature versus pulse rate, said integrated circuit controller coupled to said means for manually selecting and coupled between said heating element heat sensor and said trigger of said power transistor, for receiving the selected element temperature from said means for manually selecting and receiving the corresponding signal from said heating element heat sensor and in response to the selected element temperature, the corresponding signal and indications from said table stored in the memory of the integrated circuit controller, generating a control signal for controlling said on/off rate to said trigger of said power transistor.

17. The hair dryer/blower of claim 11, further comprises:

a voltage step-up circuit coupled between said power transistor and said heating element and coupled to said pulser circuit for receiving said on/off rate, said voltage step-up circuit providing a voltage step-up to said heating element synchronously with said trigger of said power transistor receiving pulses at said on/off rate.

18. The hair dryer/blower of claim 1, wherein said power source contains at least one rechargeable battery.

19. The hair dryer/blower of claim 18, wherein said battery supplies at least 14 volts to said manual controls.

20. The hair dryer/blower of claim 18, further comprises:

an AC/DC rectifier circuit forming part of said power source; and said AC/DC rectifier receiving the output of an AC charging circuit for enabling DC voltage to be generated for charging said at least one battery.

21. The hair dryer/blower of claim 20, wherein said power source further comprises:

an AC connection, said AC connection electrically coupled between said AC/DC rectifier circuit, and an AC receptacle connector, for receiving an output of an AC receptacle and providing said output of said AC to said AC/DC rectifier circuit of an AC charging circuit for enabling DC voltage to be generated for charging said at least one battery.

22. The hair dryer/blower of claim 21, wherein said pulsing circuit is electrically coupled between said AC/DC rectifier circuit enabling DC voltage to be generated for said pulsing circuit.

23. The hair dryer/blower of claim 1, wherein said power source further comprises:

an AC connection, said AC connection electrically coupled between one of said blower motor and said heating element, and an AC receptacle connector, for receiving an output of an AC receptacle and providing said output of said AC to said one of said blower motor and said heating element.

24. A portable hair dryer/blower comprising:

a hollow body portion having a first interior cavity and including a blower motor and a heating element disposed substantially within the first interior cavity of the hollow body portion;

a power source at least partially disposed within said first interior cavity of the hollow body portion, said power source electrically coupled to said blower motor and to said heating element, wherein said power source provides power to said blower motor and said heating element;

switch controls electrically coupled between said power source and said blower motor and between said power source and said heating element, wherein said switch controls selectively interrupts power to at least one of said blower motor and said heating element; and a pulsing circuit at least partially disposed within said first interior cavity of the hollow body portion, said pulsing circuit electrically coupled between said power source and said heating element for modulating power to said heating element, thereby establishing a duty cycle enabling stored static heat of said heating element to be expended and replenished periodically with the duty cycle.

25. The hair dryer/blower of claim 24, wherein said pulsing circuit further comprises a circuit for supplying unmodulated power to said heating element.

26. The hair dryer/blower of claim 25, wherein said circuit for supplying un-modulated comprises:

a sensor for sensing a heating element temperature and generating a corresponding signal;

a comparator for comparing a reference signal to said sensed signal and providing a first output; and a power transistor electrically coupled between said power source and said heating element, said power transistor further having a trigger electrically coupled to said comparator, wherein said power transistor provides unmodulated power to said heating element based on the first output.

27. The hair dryer/blower of claim 26, wherein said pulsing circuit further comprises:

a pulser circuit electrically connected to said trigger of said power transistor for providing output pulses to said trigger of said power transistor at an on/off rate for providing modulated power to said heating element based on the output pulses.

28. The hair dryer/blower of claim 27, further comprises a manual control coupled to said pulser circuit for setting a desired on/off rate for providing modulated power to said heating element.

29. The hair dryer/blower of claim 28, further comprising:

a voltage step-up circuit coupled between said power transistor and said heating element and coupled to said pulser circuit for receiving said on/off rate, said voltage step-up circuit providing a voltage step-up to said heating element synchronously with said trigger of said power transistor receiving pulses at said on/off rate.

30. The hair dryer/blower of claim 27, wherein said pulser circuit further comprises:

an oscillator circuit for generating sequential pulses;

a circuit for receiving said sequential pulses, said circuit comprising a plurality of serial stages, each of the plurality of serial stages generating an output pulse in response to receiving a particular pulse in said sequential pulses;

a plurality of multiple position switches, each of the plurality of multiple position switches electrically coupled between one of said plurality of serial stages and said trigger of said power transistor; and means for positioning at least some of said plurality of multiple position switches for passing at least one of said output pulses, from one of the plurality of serial stages to said trigger of said power transistor at said on/off rate.

31. The hair dryer/blower of claim 30, further comprises:

means for manually selecting an element temperature; and an integrated circuit controller having a memory and a table stored in said memory indicating heating element temperature versus pulse rate, said integrated circuit controller coupled to said means for manually selecting and coupled between said heating element heat sensor and said trigger of said power transistor, for receiving the selected element temperature from said means for manually selecting and receiving the corresponding signal from said heating element heat sensor and in response to the selected element temperature, the corresponding signal and indications from said table stored in the memory of the integrated circuit controller, generating a control signal for controlling said on/off rate to said trigger of said power transistor.

32. The hair dryer/blower of claim 31, wherein said control signal for controlling said pulse rate forming said means for positioning at least some of said plurality of multiple position switches for designating a pulse rate.

33. The hair dryer/blower of claim 27, further comprises:

means for manually selecting an element temperature; and an integrated circuit controller having a memory and a table stored in said memory indicating heating element temperature versus pulse rate, said integrated circuit controller coupled to said means for manually selecting and further coupled between said heating element heat sensor and said trigger of said power transistor for receiving the selected element temperature from said means for manually selecting and receiving the corresponding signal from said heating element heat sensor and in response to the selected element temperature, the corresponding signal and indications from said table stored in the memory of the integrated circuit controller, generating a control signal for controlling said on/off rate to said trigger of said power transistor.

34. The hair dryer/blower of claim 24, wherein said pulsing circuit further comprises:

a power transistor having an input electrically coupled to said power source, an output electrically coupled to said heating element and a trigger; and a pulser circuit electrically connected to said trigger of said power transistor for providing output pulses to said trigger of said power transistor at an on/off rate for providing modulated power to said heating element based on the output pulses.

35. The hair dryer/blower of claim 34, further comprises a manual control coupled to said pulser circuit for setting a desired on/off rate for providing modulated power to said heating element.

36. The hair dryer/blower of claim 34, wherein said pulser circuit further comprises:

an oscillator circuit for generating sequential pulses;

a circuit for receiving said sequential pulses, said circuit comprising a plurality of serial stages, each of the plurality of serial stages generating an output pulse in response to receiving a particular pulse in said sequential pulses;

a plurality of multiple position switches, each of the plurality of multiple position switches electrically coupled between one of said plurality of serial stages and said trigger of said power transistor; and means for positioning at least some of said plurality of multiple position switches for passing at least one of said output pulses from one of the plurality of serial stages to said trigger of said power transistor at said on/off rate.

37. The hair dryer/blower of claim 36, further comprises:

a sensor for sensing a heating element temperature and generating a corresponding signal;

means for manually selecting an element temperature; and an integrated circuit controller having a memory and a table stored in said memory indicating heating element temperature versus pulse rate, said integrated circuit controller coupled to said means for manually selecting and coupled between said heating element heat sensor and said trigger of said power transistor, for receiving the selected element temperature from said means for manually selecting and receiving the corresponding signal from said heating element heat sensor and in response to the selected element temperature, the corresponding signal and indications from said table stored in the memory of the integrated circuit controller, generating a control signal for controlling said on/off rate to said trigger of said power transistor.

38. The hair dryer/blower of claim 37, wherein said control signal for controlling said pulse rate forming said means for positioning at least some of said plurality of multiple position switches for designating a pulse rate.

39. The hair dryer/blower of claim 34, further comprises:

a sensor for sensing a heating element temperature and generating a corresponding signal;

means for manually selecting an element temperature; and an integrated circuit controller having a memory and a table stored in said memory indicating heating element temperature versus pulse rate, said integrated circuit controller coupled to said means for manually selecting and coupled between said heating element heat sensor and said trigger of said power transistor, for receiving the selected element temperature from said means for manually selecting and receiving the corresponding signal from said heating element heat sensor and in response to the selected element temperature, the corresponding signal and indications from said table stored in the memory of the integrated circuit controller, generating a control signal for controlling said on/off rate to said trigger of said power transistor.

40. The hair dryer/blower of claim 34, further comprises:

a voltage step-up circuit coupled between said power transistor and said heating element and coupled to said pulser circuit for receiving said on/off rate, said voltage step-up circuit providing a voltage step-up to said heating element synchronously with said trigger of said power transistor receiving pulses at said on/off rate.

41. The hair dryer/blower of claim 24, wherein said power source contains at least one rechargeable battery.

42. The hair dryer/blower of claim 41, wherein said battery supplies at least 14 volts to said manual controls.

43. The hair dryer/blower of claim 41, further comprises:

an AC/DC rectifier circuit forming part of said power source; and said AC/DC rectifier receiving the output of an AC charging circuit for enabling DC voltage to be generated for charging said at least one battery.

44. The hair dryer/blower of claim 43, wherein said power source further comprises:

an AC connection, said AC connection electrically coupled between said AC/DC rectifier circuit, and an AC receptacle connector, for receiving an output of an AC receptacle and providing said output of said AC to said AC/DC rectifier circuit of an AC charging circuit for enabling DC voltage to be generated for charging said at least one battery.

45. The hair dryer/blower of claim 44, wherein said pulsing circuit is electrically coupled between said AC/DC rectifier circuit enabling DC voltage to be generated for said pulsing circuit.

46. The hair dryer/blower of claim 24, wherein said power source further comprises:

an AC connection, said AC connection electrically coupled between one of said blower motor and said heating element, and an AC receptacle connector, for receiving an output of an AC receptacle and providing said output of said AC to said one of said blower motor and said heating element.

* * * * *